United States Patent [19]

Simmons

[11] 4,276,984

[45] Jul. 7, 1981

[54] WINE RACK

[76] Inventor: Bobbye C. Simmons, 511 Summit St., Ridgewood, N.J. 07450

[21] Appl. No.: 32,760

[22] Filed: Apr. 24, 1979

[51] Int. Cl.[3] ..... A47F 7/28

[52] U.S. Cl. ..... 211/81

[58] Field of Search ..... 211/1.3, 36, 38, 74, 211/77, 79, 80, 81, 99, 150, 170; 312/26, 30, 136, 138 A

[56] References Cited

U.S. PATENT DOCUMENTS

| | | | |
|---|---|---|---|
| D. 26,930 | 4/1897 | Truax | 211/80 |
| 219,841 | 9/1879 | Wolcott | 211/81 X |
| 1,404,270 | 1/1922 | Carr | 211/170 X |
| 1,589,198 | 6/1926 | McComb | 211/150 |
| 1,597,235 | 8/1926 | Krieger | 211/74 X |
| 2,237,879 | 4/1941 | Hinkel | 211/74 X |
| 3,131,011 | 4/1964 | Rittenberry | 312/26 X |
| 3,193,339 | 7/1965 | Cooper | 211/81 X |
| 3,194,404 | 7/1965 | Wright et al. | 211/81 |
| 3,606,023 | 9/1971 | Edmunds | 211/74 |
| 3,870,155 | 3/1975 | Galloway | 211/74 |

FOREIGN PATENT DOCUMENTS

| | | | |
|---|---|---|---|
| 2354072 | 1/1978 | France | 211/74 |
| 295954 | 4/1954 | Switzerland | 211/36 |
| 101263 | 8/1916 | United Kingdom | 211/74 |
| 872764 | 7/1961 | United Kingdom | 312/138 R |

*Primary Examiner*—Thomas J. Holko

*Attorney, Agent, or Firm*—George F. Helfrich

[57] ABSTRACT

A rack for selectively supporting or displaying one or more containers which includes at least one shelf member having opposing sides of differing utility. The shelf is rotatably movable between a non-use and use position so that when the shelf is in a non-use position it is suspended generally vertically with a decorative or finished side thereof displayed forwardly of the rack. The shelf may be selectively rotated to a use position in which the opposite side of the shelf is either generally horizontally disposed or inclined relative thereto, whereby a container may be selectively supported thereon.

3 Claims, 10 Drawing Figures

WINE RACK

BACKGROUND OF THE INVENTION

Field of the Invention

This application is generally related to support racks and is particularly directed to a rack with individually rotatable shelves having two sides of differing utility. The shelves may be maintained in a first generally vertical position when not in use to thereby display a finished or decorative side thereof forwardly of the rack or the shelves may be rotated to a second position in which a container may be selectively supported by elements carried by the opposite side of the shelves.

SUMMARY OF THE INVENTION

The present invention is embodied in a rack for selectively supporting one or more containers and having at least one shelf with a first decorative or finished surface and a second surface having cooperative elements for supporting a container. The shelf is rotatably movable between a first generally vertical position which displays the finished surface of the shelf forwardly of the rack when a container is not carried thereby and a second more horizontally inclined position so that a container may be received upon the support elements of the second surface of the shelf and be visible and readily accessible for removal therefrom. In the preferred embodiment, the shelves are suspended in such a manner that they normally assume the first generally vertical position by action of gravity alone but may be selectively rotated counterclockwise through an angle of at least 270° to the alternate position.

It is the primary object of this invention to provide a rack for storing wine bottles or other containers in which individual shelf members may have a container supporting surface or side and an oppositely disposed finished or decorative side and which sides may be selectively displayed dependent upon the selective positioning of the shelf member.

It is another object of the invention to provide a wine or similar type rack on which individual bottle or container supporting shelf elements may be selectively rotated from a first generally vertical position in which a finished or decorative portion of the shelf is displayed to a second relatively horizontal position so that bottles or other containers may be supported thereon so as to be readily accessible.

It is a further object of the invention to provide a rack for wine bottles or other containers in which the bottle engaging elements carried by the shelf members are not readily apparent or viewable until the shelf members are rotated to an inclined position to provide a supporting surface for such containers.

A further object of the invention is to provide a wine rack having a plurality of shelf elements which may be rotatably disposed relative to one another whereby only selected shelf elements need be moved to a position to receive bottles or other containers thereon.

Another object of the invention is to provide a wine or similar rack which may have utility as a self-supporting rack, a suspended rack, an article of furniture, a display rack, or as a room or wall divider.

It is another object of the invention to provide a wine or similar rack having a plurality of independently rotatable container supporting shelves which are designed, shaped and finished to provide a decorative effect or motif when such shelves are not in use.

DESCRIPTION OF THE PREFERRED EMBODIMENTS

Figure 1:
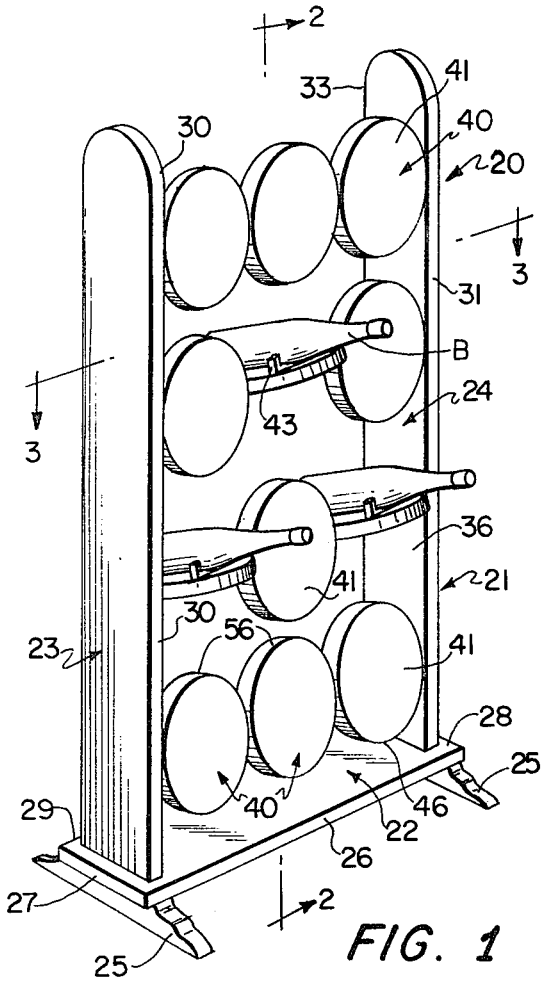
FIG. 1 is a perspective view of one form of wine rack embodying the rotatable display shelving of this invention.

With continued reference to the drawings, the preferred embodiment is shown in FIG. 1 as embodying a wine rack 20 having a frame 21 which includes a base 22 and a pair of elongated upstanding side wall members 23 and 24. The base 22 is generally horizontally disposed and is supported from a floor or other surface by legs 25. The base 22 is of generally rectangular configuration and includes a forward peripheral portion 26 which extends across the front of the rack 20, side peripheral portions 27 and 28 and rear portion 29. The upstanding side walls 23 and 24 similarly are defined by forwardly disposed wall portions 30 and 31, respectively, and rearwardly disposed wall portions 32 and 33, respectively.

The side walls 23 and 24 extend upwardly from adjacent the sides 27 and 28, respectively, of the base 22 and are in generally parallel relationship. The side walls 23 and 24 have inner surfaces 35 and 36 and outer surfaces 37 and 38, respectively. The inner surfaces of the side walls are in opposing relationship with one another.

Figure 7:
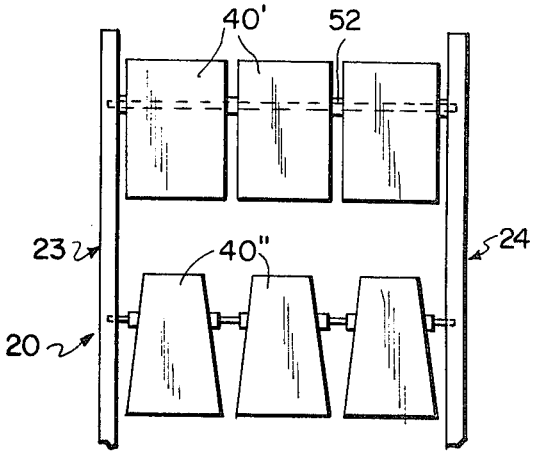
FIG. 7 is a fragmentary front elevational view of another embodiment of the invention showing differently shaped decorative shelving members.

The utility of the present invention is in providing a rack for supporting a plurality of containers which is not only functional but decorative and esthetically pleasing in appearance. In order to achieve this desired combination, the rack 20 is shown as having a plurality of rotatable container support shelves 40. In order to create various decorative or stylish patterns which may be pleasing to the consumer, the shelves may be manufactured in a variety of shapes and sizes. In FIG. 1, the shelves are shown as being of generally flat elliptical configuration. However, it is contemplated that such shelves may be round or of multi-sided configuration, such as shown in FIG. 7 and designated as 40' and 40''.

With particular reference to FIG. 1, the rack 20 is shown as having twelve such rotatable container support shelves 40 which are spaced in four rows with three shelves disposed in a generally linear relationship in each row. It should be noted that the number of shelves per row and the number of rows of shelves may be varied dependent upon how the rack is to be used.

Figure 5:
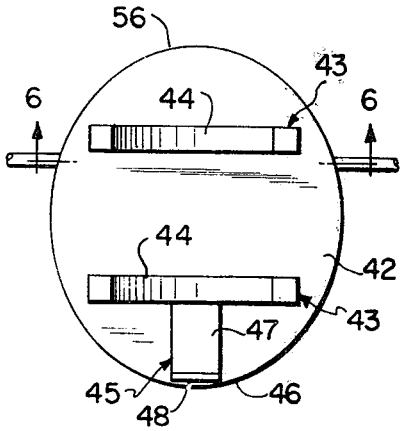
FIG. 5 is an elevational view of the container supporting surface of the rotatable shelving member of the invention.
Figure 6:
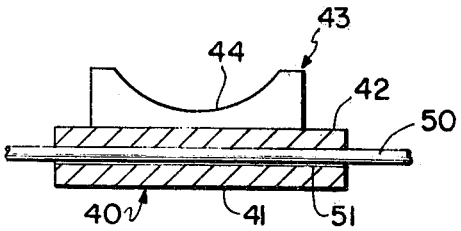
FIG. 6 is a sectional view taken along line 6—6 of FIG. 5.

Each rotatable shelf 40 has a finished or decorative front face or surface 41 and an oppositely disposed back working face or supporting surface 42. As shown in FIGS. 5 and 6, a pair of cradle or yoke members 43 are secured to the supporting surface 42 in a spaced parallel relationship. Each cradle has a container engaging portion 44 which is shown as being in a generally arcuate configuration so as to be complementary to the rounded surface of a bottle B. It should be noted that the configuration of the container engaging portion of the yoke may vary from the arcuate shape shown and perhaps may be of a V-shaped or rectilinear box-like shape. The primary factor in determining the shape of the yoke engaging portion 44 is to insure that a container which is cradled or received into engagement therewith cannot be accidentally displaced laterally of the supporting surface 42.

Figure 2:
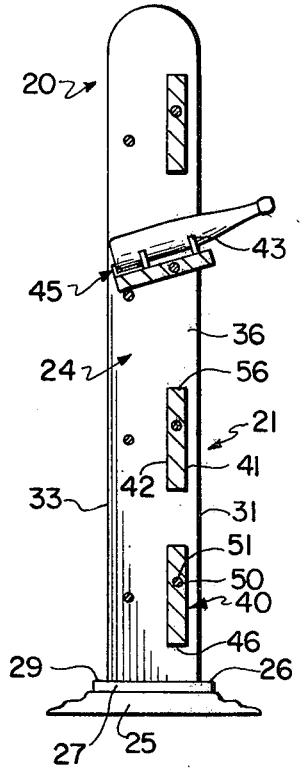
FIG. 2 is a sectional view taken along line 2—2 of FIG. 1.

To insure that the container will not slide longitudinally along the yoke members 43, a bottle stop or abutment flange 45 is secured adjacent the lower peripheral edge 46 of the supporting surface 42 of the rotating shelf so as to be in generally axial alignment with the yoke member 43. The stop member 45 is shown as being an L-shaped member having a first leg 47 which is secured to the supporting face 42 of the shelf and a second leg 48 which extends perpendicularly to the shelf face 42 and thereby serves as a rest against which the bottom of a bottle or other container may abut or engage when such container is supported in the rack, as shown in FIG. 2.

In order that the container support shelves 40 may be selectively rotated either into a first substantially vertical position with the finished face 41 of the shelf displayed forwardly of the rack, or a second or use position with the supporting surface 43 of the shelf disposed upwardly at an inclined position so as to receive a container thereon, each shelf is pivotally supported by a rod 50 which extends between, and is secured to, the upright side walls 23 and 24 of the rack. The rods are mounted adjacent the forward wall portions 30 and 31 of the respective side walls 23 and 24. In this manner, the finished face of the shelves is normally flush with or slightly recessed from the plane defining the front of the rack when the shelves are in the first or substantially vertical position. In FIGS. 1 and 2, four such rods 50 are shown for supporting the rotatable shelves.

Although the shelves 40 may be mounted in various ways on the pivot rods 50, it is preferred that each shelf have a bore 51 therethrough through which the rod 50 is passed. The bores are preferably made so as to extend between and parallel with the faces 41 and 42 of the shelves. Further, the bore should be placed so as to pass above the center of the mass of the shelf when the shelf is in its vertically disposed position. By suspending the shelves in such a manner, the weight or center of mass of each shelf will cause the shelf to tend to assume or move by gravity toward a vertical position with the finished or decorative face 41 thereof displayed forwardly of the rack, as shown in FIGS. 1 and 2.

Also, as it is preferred that each shelf be independently rotated between the first and second positions, spacers 52 may be provided between each of the shelves and between the shelves and the side walls 23 and 24 of the frame 20. Such spacers will not only permit one shelf to be manipulated without affecting the adjacent shelves, but will also prevent the shelves from shifting laterally along the pivot rod 50 and will prevent the shelves from rubbing against each other.

With reference to the earlier discussion of the shape of each of the shelves, it should be pointed out that it may be desirable in various applications to combine two or more adjacent shelves 40 into an integral shelf which could support two or more containers thereon. In such a case, the spacers 52 would only be placed between each separate unit or combination of shelves.

Figure 4:
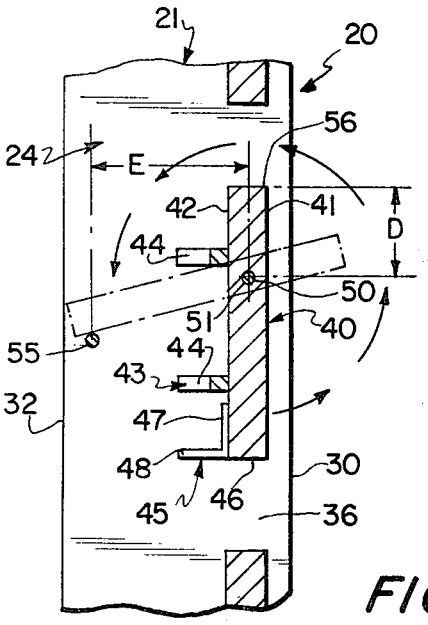
FIG. 4 is an enlarged fragmentary sectional view of one of the rotatable shelves taken along line 2—2 of FIG. 1 illustrating the degree of rotation of the shelf member.
Figure 3:
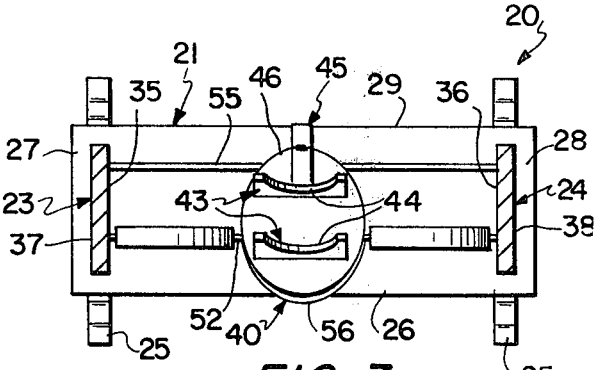
FIG. 3 is a sectional view taken along line 3—3 of FIG. 1.

Due to the configuration of the container cradle structure 43, each shelf must be tilted at an angle relative to a vertical plane, but preferably not more than 90° therefrom, so as to enable a container to be received within the yoke engaging portion 44, as shown in FIGS. 2 and 4. For example, the inclined shelf shown in FIG. 2 is angled at approximately 75° relative to a vertical plane defined by the elongated side walls 23 and 24.

Once a shelf 40 is in its inclined position, it is preferred to maintain such position whether or not a container is supported thereby so that a container which has been removed from the rack may be easily returned to the proper shelf when desired. In order to retain each shelf 40 in the second or inclined position for holding containers, a plurality of retaining rods 55 are mounted on and extend between the side walls 23 and 24. As shown in FIG. 2, there is one such retaining rod for each row of shelves. Further, the retaining rods are located either coplanar with or below the horizontal plane through the corresponding adjacent pivot rod 50. In FIG. 2, the retaining rods 55 are shown as being disposed generally lower than the adjacent pivot rods.

In addition to the vertical spacing, each retaining rod 55 should be horizontally spaced, dimension E, so as to be disposed between the pivot rods 50 and the rear walls 32 and 33 of the side walls 23 and 24 and spaced a horizontal distance D which is greater than the distance between the bore 51 and the upper portion 56 of such shelf. In FIG. 4, dimension E should therefore be greater than dimension D so that when the shelf is swinging in a counterclockwise direction, as indicated by the arrows, the upper portion 56 of the shelf 40 will not hit the retaining rod 55 but the lower portion of the shelf will engage such rod.

From the foregoing discussion, it is apparent that in order for the shelf to be properly positioned to receive a bottle of wine B or similar container, the shelf must be rotated counter-clockwise at least 270° from its vertical non-use position. FIG. 4 shows a shelf in its non-use vertical position in full lines and its use or inclined position in phantom lines.

Figure 8:
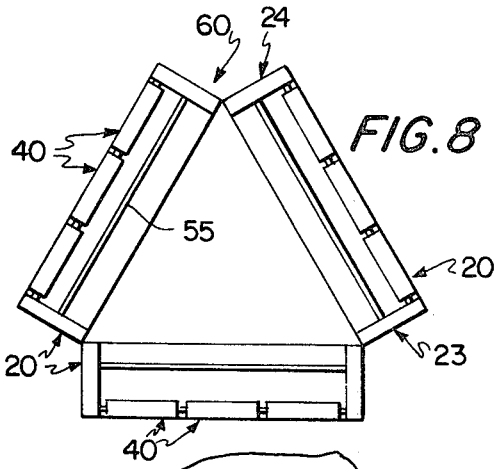
FIGS. 8 & 9 are top plan views of other embodiments of the invention showing triangular and square arrangements of the rack elements of the invention to form display cases or dividers.
Figure 9:
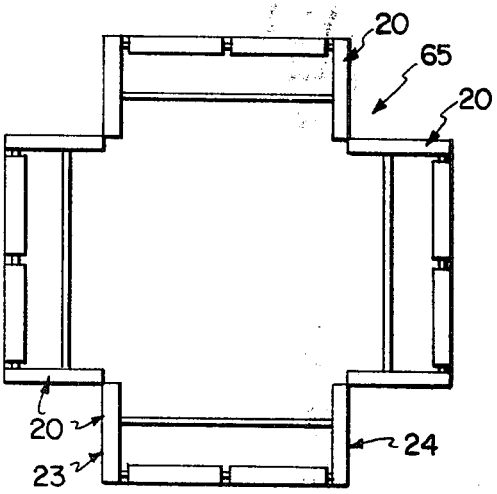

In addition to functioning as a free standing rack 20, the swingable shelves could be used in different structures. For instance, FIG. 8 shows an alternate embodiment in which the racks 20 are joined in a triangular configuration so as to form a display case 60. FIG. 9 shows a display case or room divider 65 having four joined racks 20. In either of the structure 60 or 65, such racks may be mounted on a rotatable pedestal or base (not shown) so as to rotate about a vertical axis. Thus, the type of configuration of the racks is not limited and utility may be found in a variety of environments.

Figure 10:
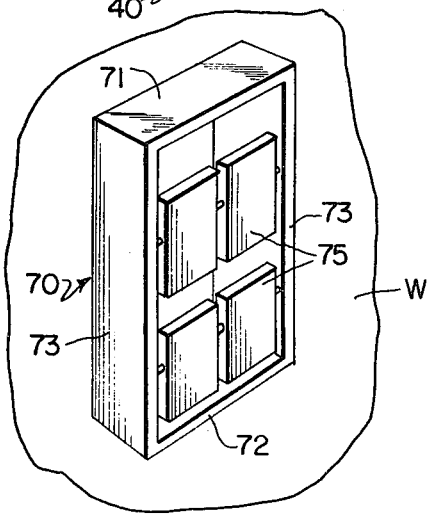
FIG. 10 is a perspective view of another embodiment of the invention which illustrates the rack being supported by a vertical surface.

In FIG. 10, another embodiment of the invention is disclosed. Particularly, a frame or cabinet 70 is shown having a top, bottom and side panels 71, 72 and 73, respectively. The cabinet may be mounted on a wall or similar vertical surface W and has four rotatable generally rectangular shelves 75 mounted therein in the same manner as discussed for the rack 20.

From the foregoing, it is apparent that the rotatable shelving of the present invention can be used in a plurality of applications and designs. Further, although the racks and shelves are preferably constucted of wood, various plastics, metals, or glass may be used or incorporated in some manner.

In the operation of the device, the cabinet or rack may be placed in a desired location, such as a dining room, family room, kitchen, or perhaps in a commercial environment. Normally the individual shelves are disposed in a vertical plane due to their center of mass being below the line of the pivoted engagement with rods. In such a position, the outer finished faces 41 combine with the structure of the rack to define a visually satisfying arrangement of shapes and design. When it is desired to place a bottle or other container in the rack, a selected shelf may be independently revolved counterclockwise thrugh an arc of at least 270° so as to cause the shelf to rest against the retaining rods or stops 55. The bottle may subsequently be placed in the cradle or yoke 43 located on the back side 42 of the shelves 40 with the bottom of the bottle engaging the stop 45.

When a particular shelf is not in use, the shelf member is rotated clockwise so that the front finished surface thereof is again displayed forwardly of the rack and thereby the yoke members mounted on the reverse side of the shelves are effectively hidden from view. Thus, a rack is provided having a finished look of quality and design.

I claim:

1. An apparatus for selectively supporting at least one container comprising frame means, said frame means including a pair of generally vertically disposed side walls, at least one shelf means disposed between said side walls, means for rotatably mounting said shelf means between said side walls, said shelf means having first and second surfaces, said means for mounting said shelf means being offset to one side of the center of mass of said shelf means so that said shelf means will normally assume a first vertical position in which said first surface of said shelf means is disposed substantially parallel to and viewable from one side of said frame means, said second surface of said shelf means having means for supporting a container thereon when said shelf means is rotated to a second position, and means for retaining said shelf means in said second position, whereby said shelf means normally is freely suspended vertically in a first position with said first side facing outwardly of said frame and is rotatably movable to a second position wherein a container may be supported on said second side of said shelf means, said shelf means being rotatable counterclockwise at least 270 degrees from said first position to said second position.

2. An apparatus for selectively supporting at least one container comprising frame means, said frame means including a pair of generally vertically disposed side walls, at least one shelf means disposed between said side walls, means for rotatably mounting said shelf means between said side walls, said shelf means having first and second surfaces, said means for mounting said shelf means being offset to one side of the center of mass of said shelf means so that said shelf means will normally assume a first vertical position in which said first surface of said shelf means is disposed substantially parallel to and viewable from one side of said frame means, said second surface of said shelf means having means for supporting a container thereon when said shelf means is rotated to a second position, and means for retaining said shelf means in said second position, whereby said shelf means normally is freely suspended vertically in a first position with said first side facing outwardly of said frame and is rotatably movable to a second position wherein a container may be supported on said second side of said shelf means, the means for retaining said shelf means in said second position including an elongated rod means disposed between said side walls and being positioned so as to abut said first surface of said shelf means after said shelf means is rotated counterclockwise at least 270 degrees from said first position.

3. A rack for selectively receiving a plurality of bottles comprising a frame having generally parallel side walls and front and rear surfaces, at least one elongated first rod means extended between and supported by said side walls, a plurality of shelf means rotatably mounted on said rod means, said shelf means having front and rear surfaces, said rod means being offset to one side of the center of mass of said shelf means so that said shelf means normally assumes a first vertical position with said front surface thereof viewable from said front surface of said frame, second rod means for selectively abutting said front face of said shelf means when said shelf means is rotated to a second position, said second rod means extending generally parallel to said first rod means and said second position being at least 270° counterclockwise about said first rod means from said first vertical position, and retaining means on said rear surface of said shelf means to receive a container therein when said shelf means is in said second position with said front surface thereof abutting said second rod means.

* * * * *